US012653313B2

(12) United States Patent
Pan et al.

(10) Patent No.: US 12,653,313 B2
(45) Date of Patent: Jun. 16, 2026

(54) CONCEALED CUP HOLDER ASSEMBLY

(71) Applicant: MOTOMOTION CHINA CORPORATION, Changzhou (CN)

(72) Inventors: Wu Qing Pan, Changzhou (CN); Ying Wang, Kunshan (CN); Peng He, Changzhou (CN)

(73) Assignee: MOTOMOTION CHINA CORPORATION, Changzhou (CN)

( * ) Notice: Subject to any disclaimer, the term of this patent is extended or adjusted under 35 U.S.C. 154(b) by 257 days.

(21) Appl. No.: 18/731,249

(22) Filed: Jun. 1, 2024

(65) Prior Publication Data

US 2025/0261762 A1 Aug. 21, 2025

(30) Foreign Application Priority Data

Feb. 19, 2024 (CN) ..... 202420308277.X

(51) Int. Cl.
*A47C 7/62* (2006.01)

(52) U.S. Cl.
CPC ..... *A47C 7/624* (2018.08)

(58) Field of Classification Search
CPC ..... A47C 7/624; A47C 7/622; B60N 3/10; B60N 3/102; B60N 2/793
See application file for complete search history.

(56) References Cited

U.S. PATENT DOCUMENTS 5,232,262 A * 8/1993 Tseng ..... A47C 7/54 297/188.17
10,681,987 B2 * 6/2020 Liu ..... A47C 31/008
(Continued)

FOREIGN PATENT DOCUMENTS

DE 19963202 A1 * 6/2001 ..... B60N 3/106

*Primary Examiner* — David R Dunn
*Assistant Examiner* — Jessica Kathryn Thompson
(74) *Attorney, Agent, or Firm* — Law Offices of Steven W. Weinrieb

(57) ABSTRACT

A concealed cup holder assembly comprises a cup holder housing, within which a cup holder is disposed, which is fixedly connected to an upper front panel of an armrest of a chair, and wherein the upper front panel of the armrest of the chair is pivotally mounted upon a lower front panel of the armrest of the chair. A telescopic cylinder has a first end thereof operatively connected to the cup holder housing, while a second opposite end thereof is operatively connected to an internal support panel of the armrest of the chair. When the cup holder housing is to be moved from its retracted position to its extended position, a user grasps the upper front panel of the armrest of the chair and moves the upper front panel of the armrest of the chair forwardly. Conversely, when the cup holder housing is to be moved from its extended position to its retracted position, the user exerts a pushing force upon the upper front panel of the armrest of the chair so as to move the upper front panel of the armrest of the chair rearwardly. When the cup holder assembly is disposed at its retracted position, the telescopic cylinder will effectively be disposed parallel to the internal support panel of the armrest of the chair, whereas when the cup holder assembly is disposed at its extended position, the telescopic cylinder will effectively be disposed at a predetermined inclined position with respect to the internal support panel of the armrest of the chair.

20 Claims, 11 Drawing Sheets

(56) References Cited

U.S. PATENT DOCUMENTS

| | | | | |
|---|---|---|---|---|
| 11,034,306 | B2 * | 6/2021 | An | B60N 2/793 |
| 11,260,785 | B1 * | 3/2022 | Pabalate | B60N 3/106 |
| 12,232,631 | B2 * | 2/2025 | Liu | A47C 7/622 |

* cited by examiner

CONCEALED CUP HOLDER ASSEMBLY

FIELD OF THE INVENTION

The present invention relates generally to cup holder assemblies, and more particularly to a concealed cup holder assembly for use within chairs, love seats, sofas, and the like.

BACKGROUND OF THE INVENTION

Cup holder assemblies are often incorporated within chairs, love seats, sofas, and the like, so as to provide convenient access to a beverage for the occupant of the chair, love seat, or sofa when the occupant of the chair, love seat, or sofa is watching TV, reading a book, or enjoying some other kind of recreational activity. Cup holder assemblies are also often concealed within the arm, or other frame portion of the chair, love seat, or sofa, for aesthetic or cleanliness purposes. If they were not concealed, such cup holder assemblies would tend to accumulate dust or other debris. In addition, by concealing the cup holder assemblies, the structure of the cup holder assembly is effectively incorporated within the overall structure of the chair, love seat, or sofa, thereby presenting or providing the chair, love seat, or sofa with a smooth or clean aesthetic appearance. Examples of concealed cup holder assemblies for chairs, love seats, sofas, and the like, can be found within U.S. Pat. No. 10,681,987 which issued to Liu et al. on Jun. 16, 2020; and U.S. Pat. No. 11,490,736 which issued to Liu et al. on Nov. 8, 2922. However, it has been realized that such exemplary concealed cup holder assemblies may comprise relatively complex operational mechanisms, that such exemplary concealed cup holder assemblies may comprise relatively complex operational mechanisms which are not readily convenient or easy to operate, and that such exemplary concealed cup holder assemblies may comprise relatively complex operational mechanisms which may, in effect, require or occupy a relatively large space or footprint in order to be properly accommodated within the framework of the chair, love seat, sofa, or the like.

A need therefore exists in the art for a new and improved cup holder assembly. Another need exists in the art for a new and improved cup holder assembly which can be readily incorporated within a chair, love seat, sofa, or the like. Still another need exists in the art for a new and improved cup holder assembly which can be readily incorporated within a chair, love seat, sofa, or the like, and wherein the cup holder assembly comprises a concealed cup holder assembly. Yet another need exists in the art for a new and improved cup holder assembly which can be readily incorporated within a chair, love seat, sofa, or the like, and wherein the cup holder assembly comprises a concealed cup holder assembly such that the cup holder assembly does not readily collect dust or debris. Still yet another need exists in the art for a new and improved cup holder assembly which can be readily incorporated within a chair, love seat, sofa, or the like, wherein the cup holder assembly comprises a concealed cup holder assembly such that the cup holder assembly does not readily collect dust or debris, and wherein the cup holder assembly provides the chair, love seat, sofa, or the like, with an aesthetically pleasing appearance. Yet still another need exists in the art for a new and improved cup holder assembly which can be readily incorporated within a chair, love seat, sofa, or the like, wherein the cup holder assembly comprises a concealed cup holder assembly such that the cup holder assembly does not readily collect dust or debris, wherein the cup holder assembly provides the chair, love seat, sofa, or the like, with an aesthetically pleasing appearance, and wherein the cup holder assembly comprises a relatively simplified operational mechanism. An additional need exists in the art for a new and improved cup holder assembly which can be readily incorporated within a chair, love seat, sofa, or the like, wherein the cup holder assembly comprises a concealed cup holder assembly such that the cup holder assembly does not readily collect dust or debris, wherein the cup holder assembly provides the chair, love seat, sofa, or the like, with an aesthetically pleasing appearance, and wherein the cup holder assembly comprises a relatively simplified operational mechanism such that the concealed cup holder assembly is readily convenient or easy to operate. A last need exists in the art for a new and improved cup holder assembly which can be readily incorporated within a chair, love seat, sofa, or the like, wherein the cup holder assembly comprises a concealed cup holder assembly such that the cup holder assembly does not readily collect dust or debris, wherein the cup holder assembly provides the chair, love seat, sofa, or the like, with an aesthetically pleasing appearance, wherein the cup holder assembly comprises a relatively simplified operational mechanism such that the concealed cup holder assembly is readily convenient or easy to operate, and wherein, in effect, the cup holder assembly only requires or occupies a relatively small space or footprint in order to be properly accommodated within the framework of the chair, love seat, sofa, or the like.

Overall Objectives of the Invention

An overall objective of the present invention is to provide a new and improved cup holder assembly. Another overall objective of the present invention is to provide a new and improved cup holder assembly which can be readily incorporated within a chair, love seat, sofa, or the like. Still another overall objective of the present invention is to provide a new and improved cup holder assembly which can be readily incorporated within a chair, love seat, sofa, or the like, and wherein the cup holder assembly comprises a concealed cup holder assembly. Yet another overall objective of the present invention is to provide a new and improved cup holder assembly which can be readily incorporated within a chair, love seat, sofa, or the like, and wherein the cup holder assembly comprises a concealed cup holder assembly such that the cup holder assembly does not readily collect dust or debris. Still yet another overall objective of the present invention is to provide a new and improved cup holder assembly which can be readily incorporated within a chair, love seat, sofa, or the like, wherein the cup holder assembly comprises a concealed cup holder assembly such that the cup holder assembly does not readily collect dust or debris, and wherein the cup holder assembly provides the chair, love seat, sofa, or the like, with an aesthetically pleasing appearance.

Yet still another overall objective of the present invention is to provide a new and improved cup holder assembly which can be readily incorporated within a chair, love seat, sofa, or the like, wherein the cup holder assembly comprises a concealed cup holder assembly such that the cup holder assembly does not readily collect dust or debris, wherein the cup holder assembly provides the chair, love seat, sofa, or the like, with an aesthetically pleasing appearance, and wherein the cup holder assembly comprises a relatively simplified operational mechanism. An additional overall objective of the present invention is to provide a new and improved cup holder assembly which can be readily incorporated within a chair, love seat, sofa, or the like, wherein the cup holder assembly comprises a concealed cup holder assembly such that the cup holder assembly does not readily collect dust or debris, wherein the cup holder assembly provides the chair, love seat, sofa, or the like, with an aesthetically pleasing appearance, and wherein the cup holder assembly comprises a relatively simplified operational mechanism such that the concealed cup holder assembly is readily convenient or easy to operate. A last overall objective of the present invention is to provide a new and improved cup holder assembly which can be readily incorporated within a chair, love seat, sofa, or the like, wherein the cup holder assembly comprises a concealed cup holder assembly such that the cup holder assembly does not readily collect dust or debris, wherein the cup holder assembly provides the chair, love seat, sofa, or the like, with an aesthetically pleasing appearance, wherein the cup holder assembly comprises a relatively simplified operational mechanism such that the concealed cup holder assembly is readily convenient or easy to operate, and wherein, in effect, the cup holder assembly only requires or occupies a relatively small space or footprint in order to be properly accommodated within the framework of the chair, love seat, sofa, or the like.

SUMMARY OF THE INVENTION

The foregoing and other objectives are achieved by means of a new and improved concealed cup holder assembly which is seen to comprise a cup holder housing, within which a cup holder is disposed, which is fixedly connected to an upper front panel of an armrest of a chair, and wherein the upper front panel of the armrest of the chair is pivotally mounted upon a lower front panel of the armrest of the chair. A telescopic cylinder has a first end thereof operatively connected to the cup holder housing, while a second opposite end thereof is operatively connected to an internal support panel of the armrest of the chair. When the cup holder housing, having the cup holder disposed therein, is to be moved from its retracted, stowed, or concealed or covered position, to its extended, deployed, or uncovered position, a user grasps the upper front panel of the armrest of the chair and moves the upper front panel of the armrest of the chair forwardly. Conversely, when the cup holder housing, having the cup holder disposed therein, is to be moved from its extended, deployed, or unconcealed or uncovered position, to its retracted, stowed, or concealed or covered position, the user exerts a pushing force upon the upper front panel of the armrest of the chair so as to move the upper front panel of the armrest of the chair rearwardly. When the cup holder housing is disposed at its retracted, stowed, or concealed or covered position, the telescopic cylinder will effectively be disposed parallel to the internal support panel of the armrest of the chair, whereas when the cup holder housing is disposed at its extended, deployed, or unconcealed or uncovered position, the telescopic cylinder will effectively be disposed at an inclined position with respect to the internal support panel of the armrest of the chair, these different dispositions of the telescopic cylinder effectively contributing to the compact, small footprint of new and improved concealed cup holder assembly.

BRIEF DESCRIPTIONS OF THE DRAWINGS

Various other features and attendant advantages of the present invention will be more fully appreciated from the following detailed description when considered in connection with the accompanying drawings in which like reference characters designate like or corresponding parts throughout the several views, and wherein.

Figure 8:
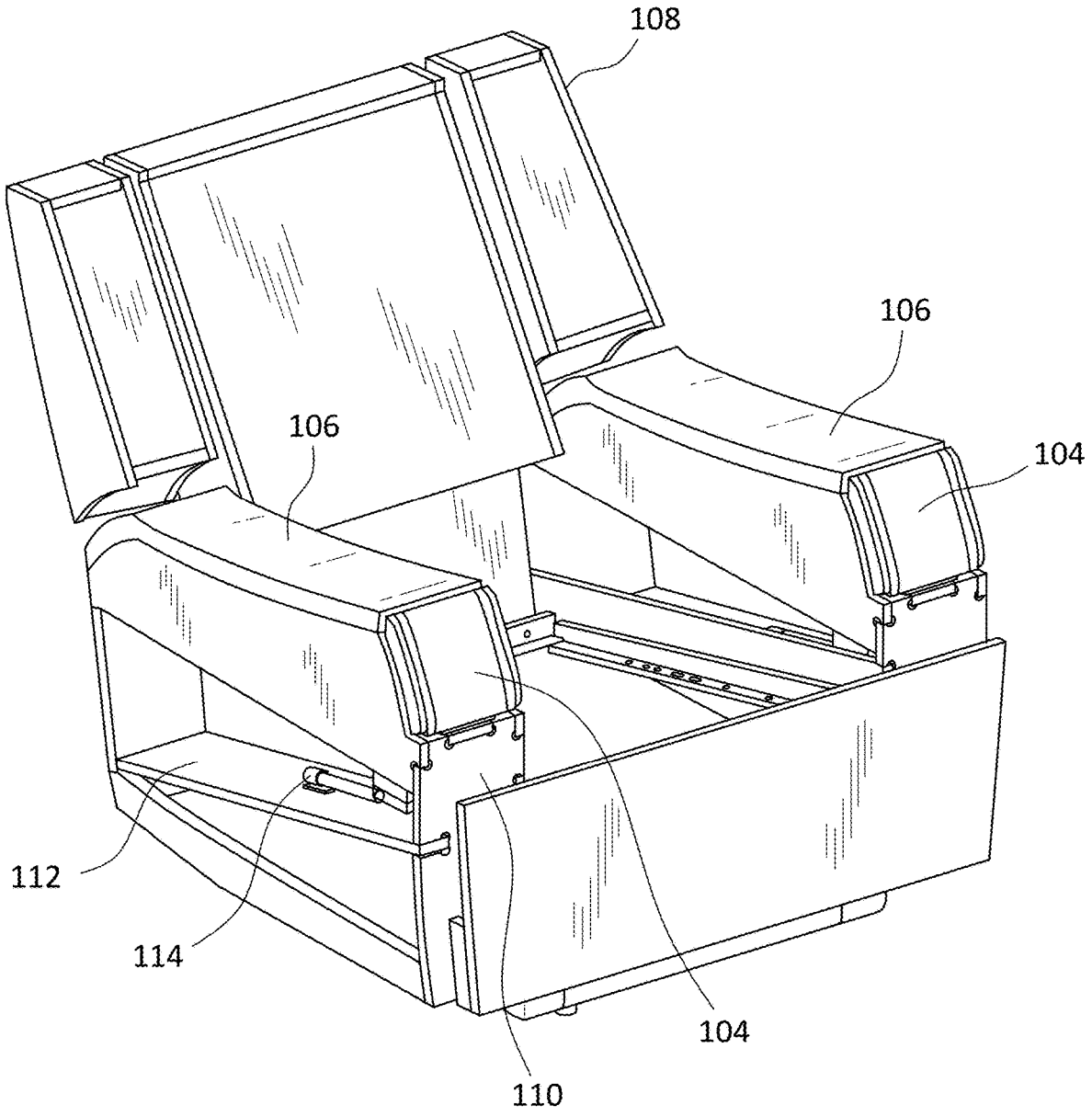
Figure 9:
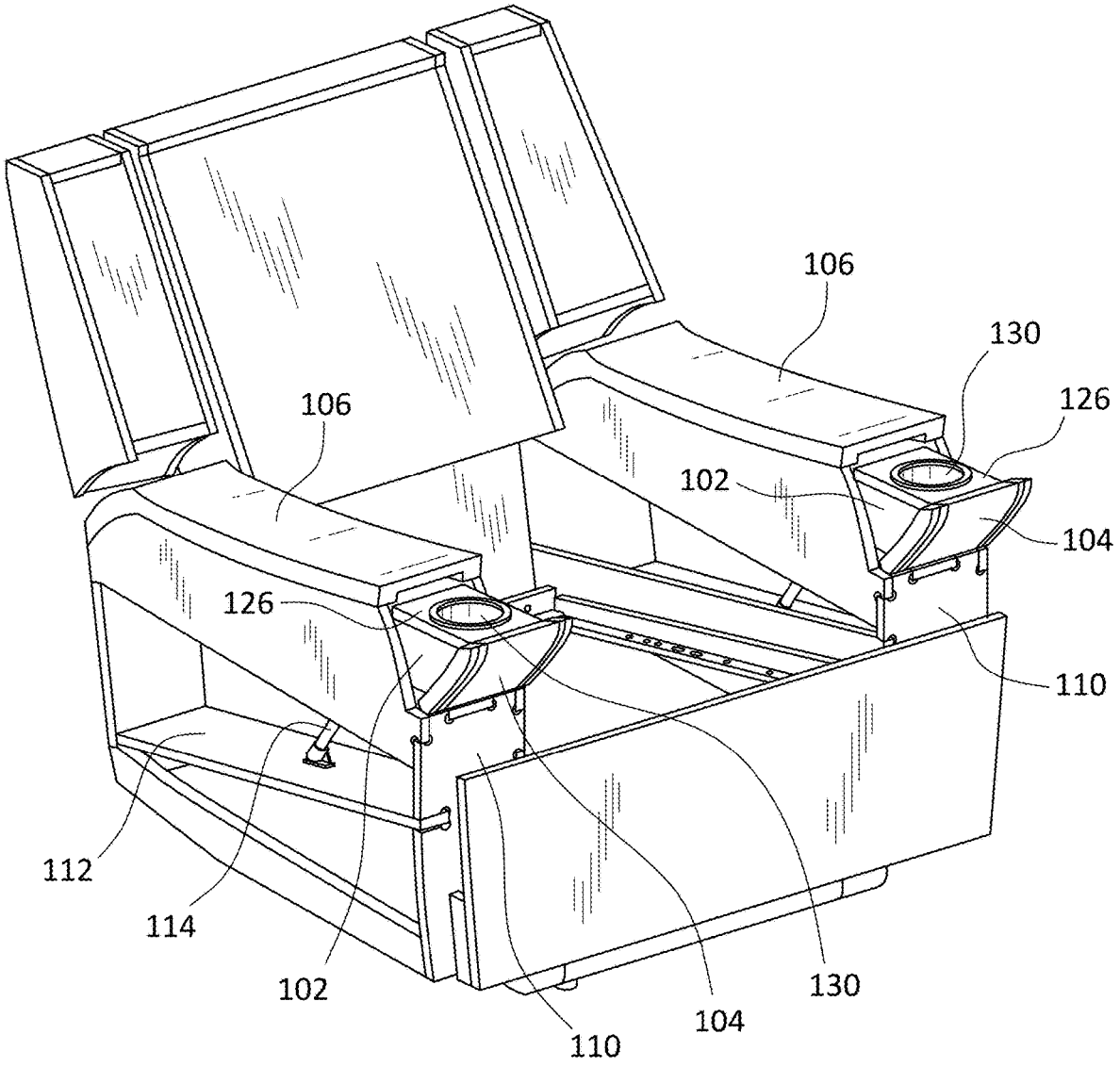

FIG. 8 is a front, left side perspective view of a chair that has the new and improved concealed cup holder assemblies incorporated therein, wherein the cup holder assemblies are disposed at their retracted, stowed, or concealed or covered positions internally within the armrests of the chair; and FIG. 9 is a front, left side perspective view of the chair, as illustrated within FIG. 8, wherein, however, the new and improved concealed cup holder assemblies, incorporated therein, are now disposed at their extended, deployed, or exposed or uncovered positions externally of the armrests of the chair.

DETAILED DESCRIPTION OF THE PREFERRED EMBODIMENT

Figure 1:
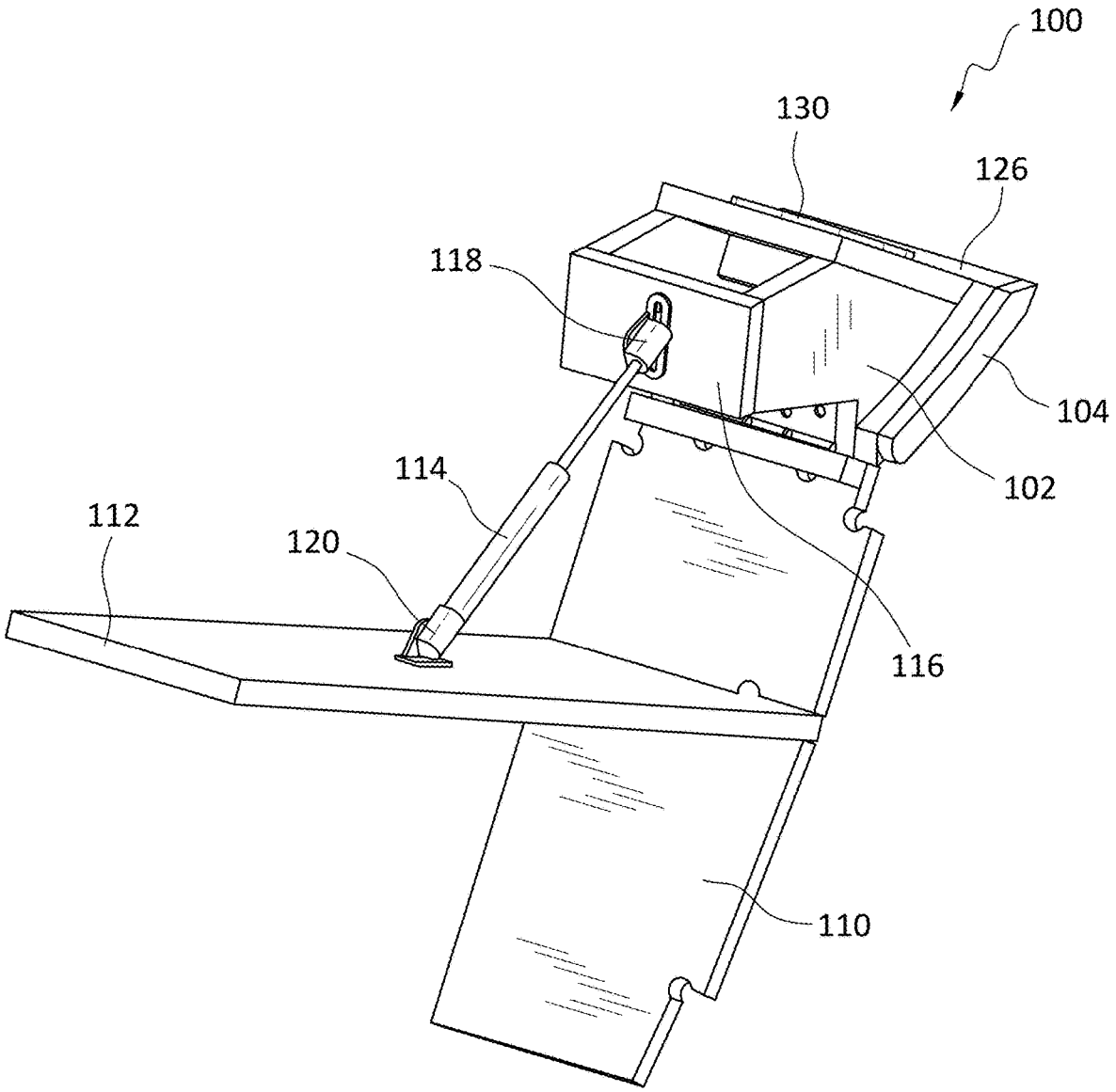
FIG. 1 is a rear, right side perspective view of a new and improved concealed cup holder assembly as developed in accordance with the principles and teachings of the present invention, and illustrating the cup holder housing when the same is disposed at its extended, deployed, and exposed or uncovered state.
Figure 2:
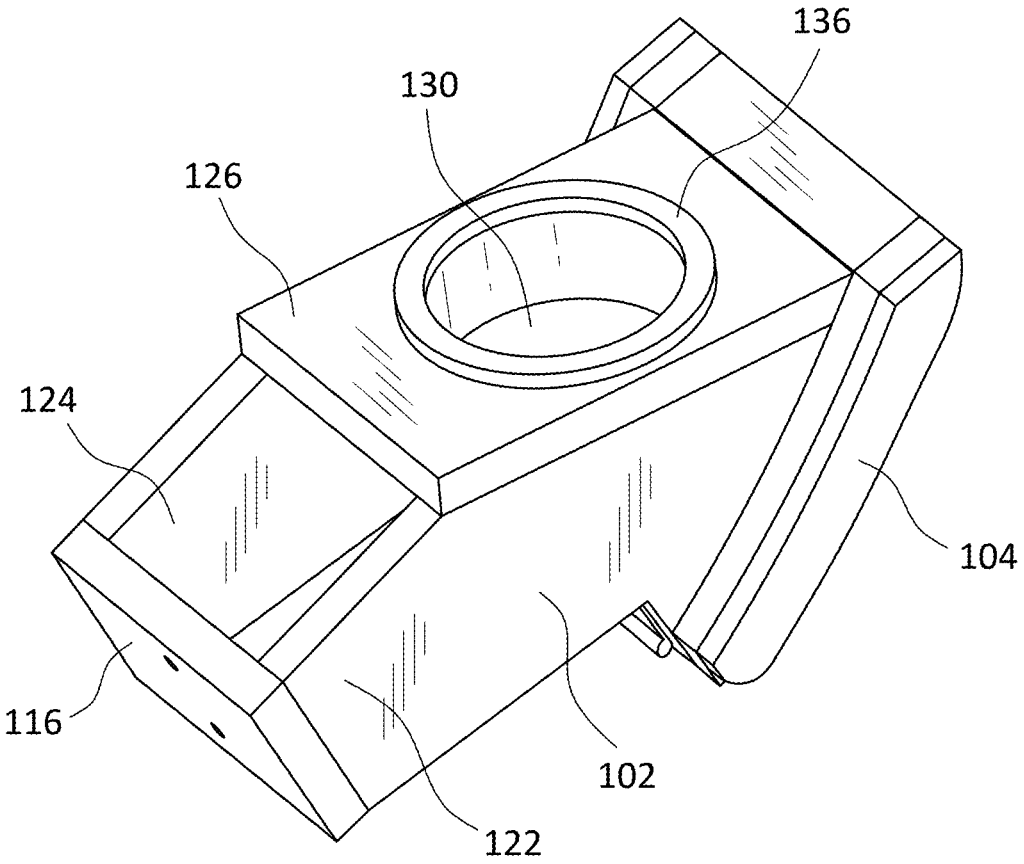
FIG. 2 is a rear, right side perspective view of a cup holder housing to be operatively connected to the new and improved concealed cup holder assembly as illustrated within FIG. 1.
Figure 3:
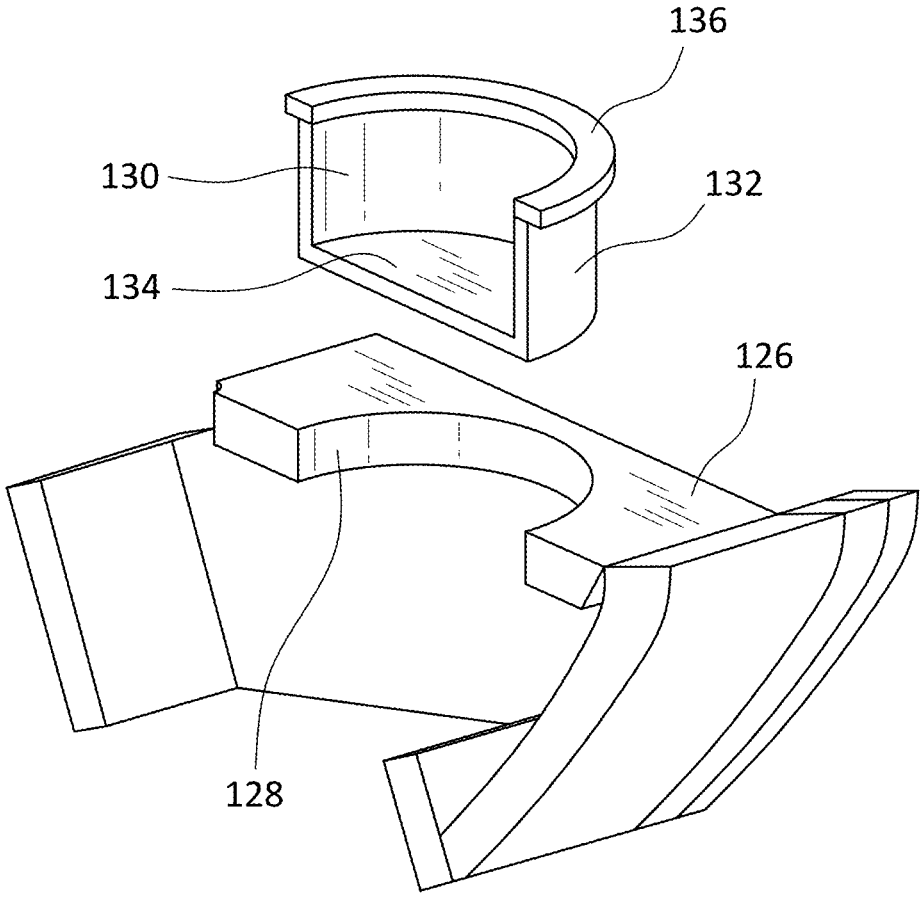
FIG. 3 is a cross-sectional, exploded view of the cup holder housing as illustrated within FIG. 2.

Referring now to the drawings, and more particularly to FIG. 1 thereof, a new and improved concealed cup holder assembly, as developed in accordance with the principles and teachings of the present invention, is disclosed and is generally indicated by the reference character 100. More particularly, it is seen that the new and improved concealed cup holder assembly 100 comprises a cup holder housing 102 which has a front panel fixedly mounted upon an upper front panel 104 of an armrest 106 of a chair 108, and wherein the upper front panel 104 of the armrest 106 of the chair 108 is pivotally mounted upon a lower front panel 110 of the armrest 106 of the chair 108, by means of a suitable hinge mechanism, not shown, all as can best be appreciated as a result of additional reference being made to FIGS. 8 and 9. In addition, with reference continuing to be made to FIGS. 1,8, and 9, it is seen that the cup holder housing 102 is operatively connected to an internal support panel 112 of the armrest 106 of the chair 108 by means of a suitable telescopic cylinder 114 which has a first end thereof pivotally connected to a rear panel 116 of the cup holder housing 102 by means of a first pivot mechanism 118, while a second, opposite end of the telescopic cylinder 114 is pivotally connected to the internal support panel 112 of the armrest 106 of the chair 108 by means of a second pivot mechanism 120, the internal support panel 112 of the armrest 106 of the chair 108 also being fixedly connected to the lower front panel 110 of the chair 108. As can best be seen and appreciated from FIG. 2, the cup holder housing 102 additionally includes a pair of oppositely disposed side walls or panels 122,124, which effectively connect the rear panel 116 of the cup holder housing 102 to the upper front panel 104 of the armrest 106, and an upper panel 126 which is fixedly connected to upper end/edge portions of the pair of oppositely disposed side walls/panels 122,124 as well as to the upper front panel 104 of the armrest 106. Still further, it is seen that the upper panel 126 of the cup holder housing 102 is provided with a hole or aperture 128, as can best be seen in FIG. 3, within which a cup holder 130 is adapted to be disposed. More particularly, it is seen that the cup holder 130 comprises a cylindrical body 132, a floor 134, and an annular flange portion 136 which is integrally connected to the upper end of the cylindrical body 132 and which is adapted to be seated upon the upper surface portion of the upper panel 126 of the cup holder housing 102 when the cup holder 130 is inserted into the hole or aperture 128 of the cup holder housing 102, as can best be seen in FIG. 2.

Figure 5:
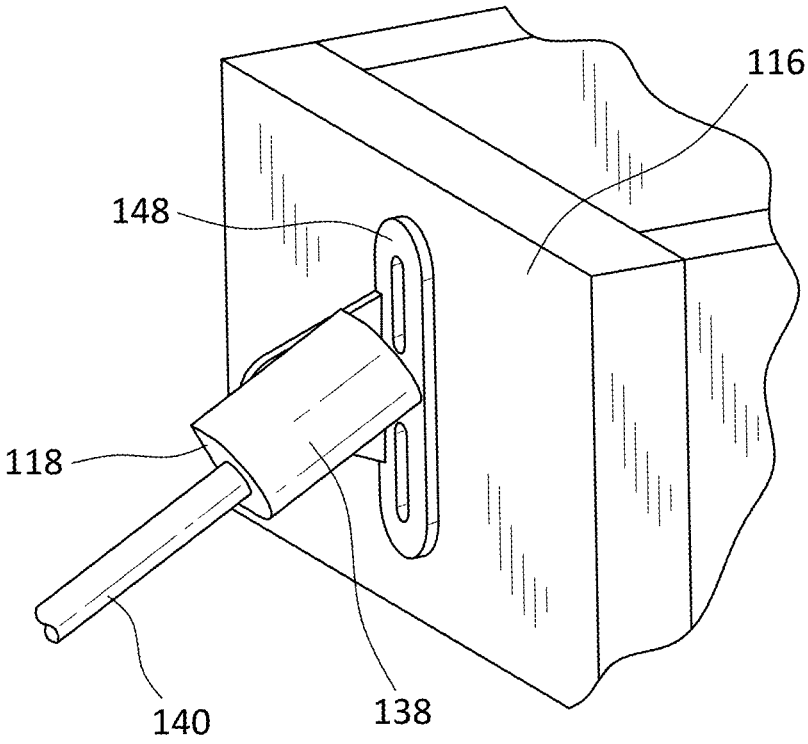
FIG. 5 is an enlarged detailed view of the region denoted by "5" in FIG. 4, illustrating some of the details of the operative connection of a first end of the telescopic cylinder with the rear wall of the cup holder housing.
Figure 5A:
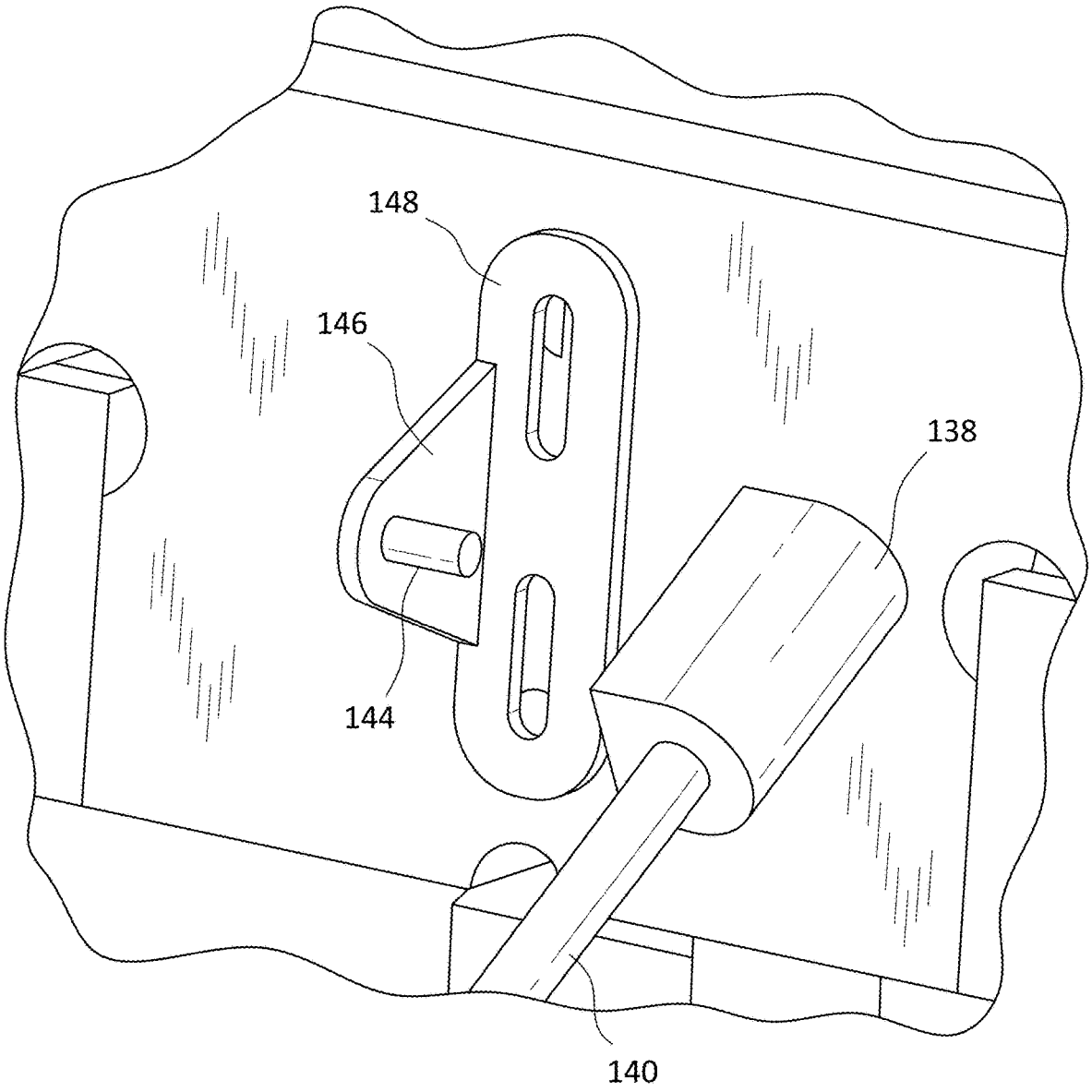
FIG. 5A is an enlarged detailed view showing the detailed structure of the operative connection of the first end of the telescopic cylinder to its mounting bracket fixedly mounted upon the rear wall of the cup holder housing.
Figure 5B:
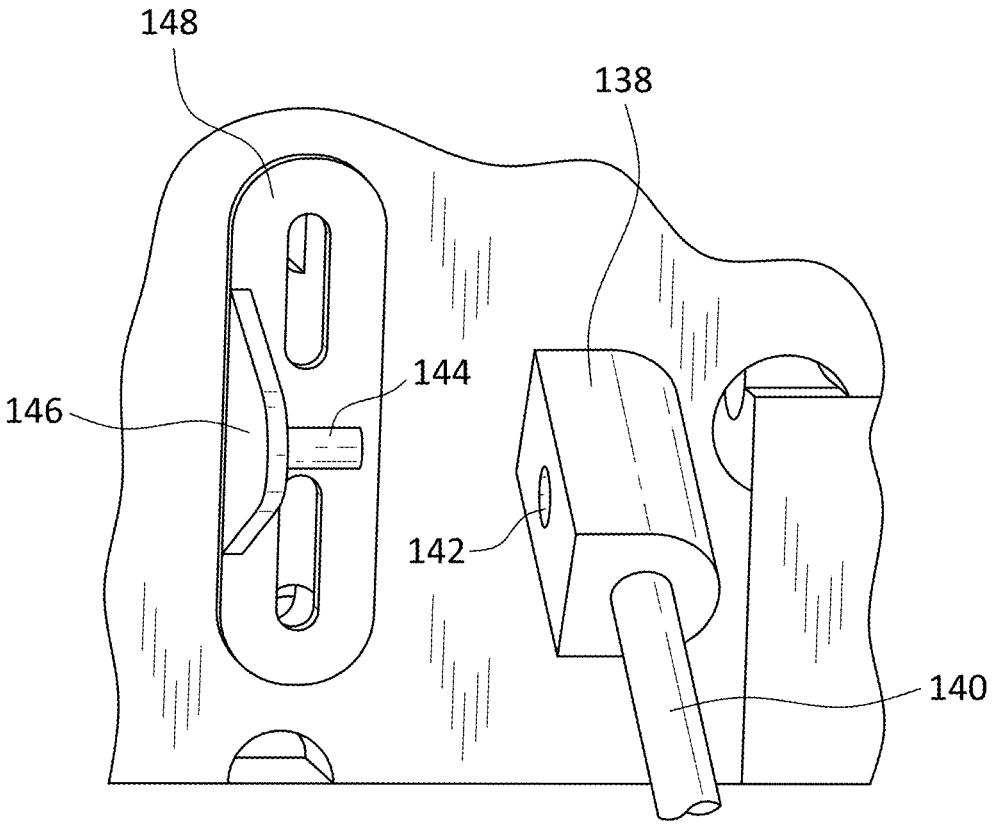
FIG. 5B is an enlarged detailed view showing additional detailed structure of the operative connection of the first end of the telescopic cylinder to the mounting bracket fixedly mounted upon the rear wall of the cup holder housing.
Figure 6:
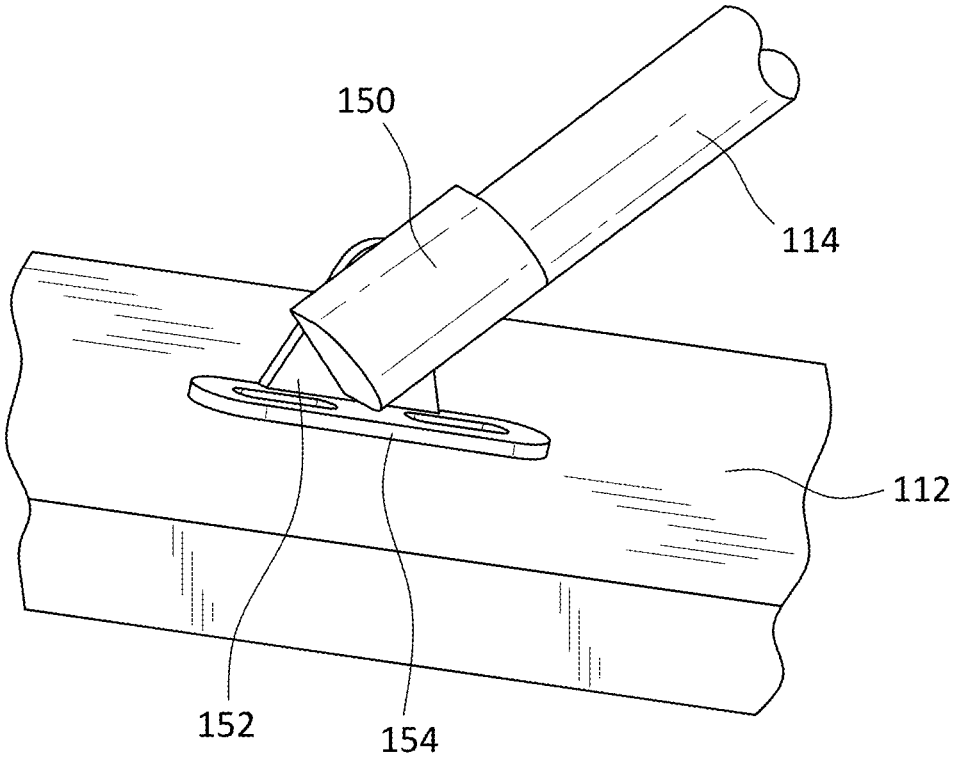
FIG. 6 is an enlarged detailed view of the region denoted by "6" in FIG. 4, illustrating some of the details of the operative connection of the second opposite end of the telescopic cylinder with an internal support panel of the armrest of the chair, love seat, or sofa.

With reference now being made to FIGS. 5, 5A, and 5B, the details of the first pivot mechanism 118, defined between the first end of the telescopic cylinder 114 and the rear panel 116 of the cup holder housing 102, will now be described. More particularly, it is seen that the first pivot mechanism 118 comprises a female housing 138 which is fixedly mounted upon the free end portion of a telescopic rod 140 of the telescopic cylinder 114. The female housing 138 has a hole or aperture 142 defined therein, and a male pin 144 is fixedly mounted upon a mounting bracket 146 which is fixedly mounted upon, or integral with, a mounting plate 148. In turn, the mounting plate 148 is fixedly mounted upon the rear panel 116 of the cup holder housing 102, and together, the male pivot pin 144 and the female hole or aperture 142 define a pivotal connection for the telescopic cylinder 114 with respect to the rear panel of the cup holder housing 102. In a similar manner, with reference being made to FIG. 6, the details of the second pivot mechanism 120, defined between the second end of the telescopic cylinder 114 and the internal support panel 112 of the armrest 106 of the chair 108, will now be described. More particularly, it is seen that the second pivot mechanism 120 comprises a female housing 150 which is fixedly mounted upon the housing end portion of the telescopic cylinder 114. The female housing 150 has a hole or aperture, not shown, but similar to the hole or aperture 142 defined within the female housing 138, and a male pin, not shown, but similar to the male pin 144, is fixedly mounted upon a mounting bracket 152 which is fixedly mounted upon, or integral with, a mounting plate 154. In turn, the mounting plate 154 is fixedly mounted upon the internal support panel 112 of the armrest 106 of the chair 108, and together, the male pivot pin and the female hole or aperture define a pivotal connection for the telescopic cylinder 114 with respect to the internal support panel 112 of the armrest 106 of the chair 108.

Having described substantially all of the structural components comprising the new and improved concealed cup holder assembly 100, a brief description of the operation of the same will now be provided. More particularly, FIG. 7 discloses the new and improved concealed cup holder assembly 100 when the same is disposed at its retracted, stowed, or concealed or covered position, and accordingly, when it is desired to move the new and improved concealed cup holder assembly 100 from its retracted, stowed, or concealed or covered position, as illustrated within FIG. 7, to its extended, deployed, or unconcealed or uncovered position as illustrated within FIG. 1, a user grasps the forward face of the upper front panel 104 of the armrest 106 of the chair 108, and moves the same forwardly. Accordingly, the upper front panel 104 of the armrest 106 of the chair 108 will be moved from its disposition as illustrated within FIG. 7 to that illustrated within FIGS. 1 and 4. As a result, the telescopic cylinder 114 will effectively be altered from its retracted or collapsed state, as illustrated within FIG. 7, to its extended state as illustrated within FIGS. 1 and 4.

Figure 4:
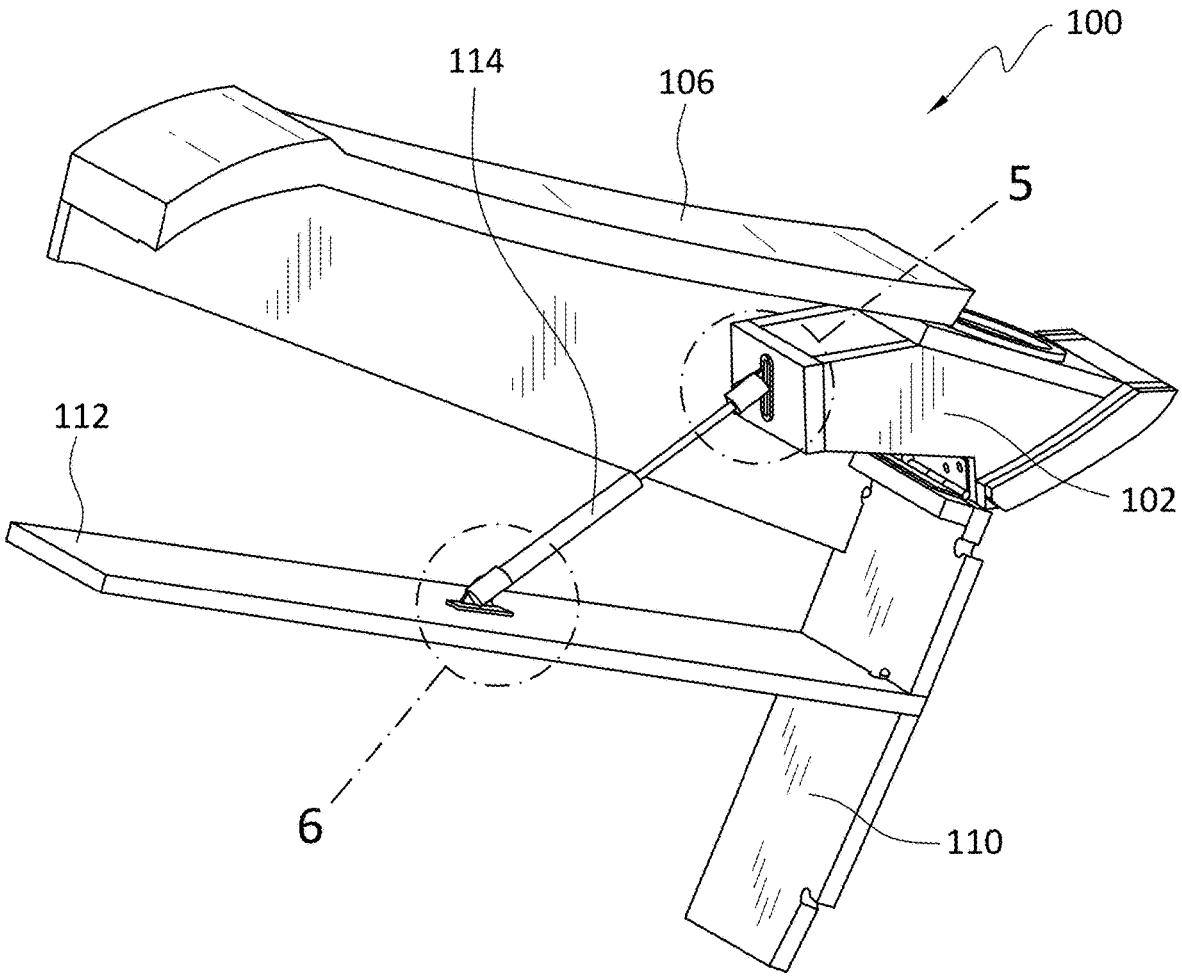
FIG. 4 is an enlarged rear, right side perspective view of the new and improved concealed cup holder assembly, as illustrated within FIG. 1, illustrating, however, the cup holder housing when the same is disposed at its extended, deployed, or exposed or uncovered state.
Figure 7:
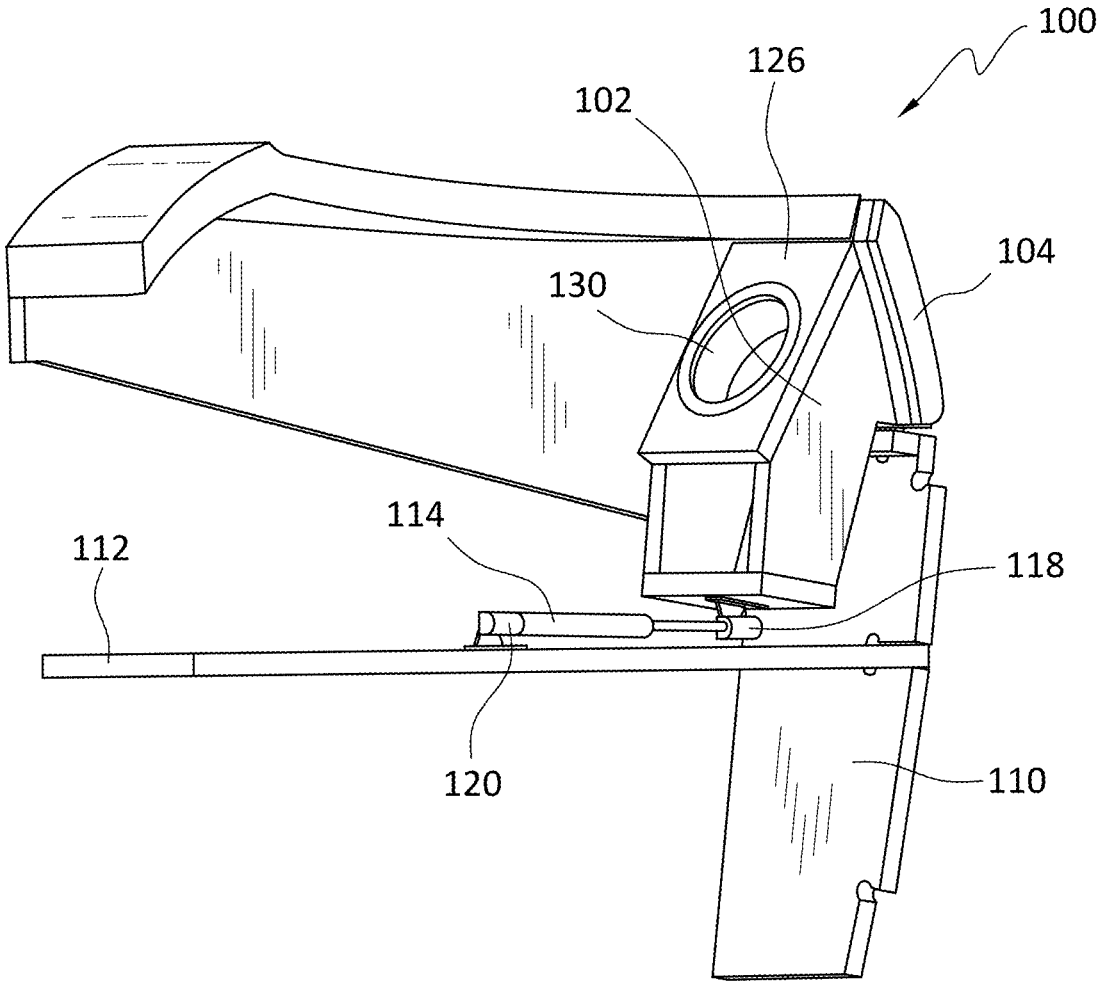
FIG. 7 is a rear, side perspective view of the new and improved concealed cup holder assembly when the concealed cup holder assembly is disposed at its retracted, stowed, or concealed or covered position internally within the armrest of the chair, love seat, or sofa.

It is to be noted that when the cup holder assembly 100 is disposed at its retracted, stowed, or concealed or covered position, as illustrated within FIG. 7, the telescopic cylinder 114 will effectively be disposed parallel to the internal support panel 112 of the armrest 106 of the chair 108, whereas when the cup holder assembly 100 is disposed at its extended, deployed, or unconcealed or uncovered position, as illustrated within FIGS. 1 and 4, the telescopic cylinder 114 will effectively be disposed at a predetermined inclined position with respect to the internal support panel 112 of the armrest 106 of the chair 108, these different dispositions of the telescopic cylinder 114 effectively contributing to the compact, small footprint of new and improved concealed cup holder assembly 100. It is to be additionally noted that these dispositions of the upper front panels 104 of the armrests 106 of the chair 108, as well as the dispositions of the cup holders 130, can also be readily appreciated from FIGS. 8 and 9. Conversely, when the new and improved cup holder assembly 100 is disposed at its extended, deployed, or unconcealed or uncovered position as illustrated within FIG. 1, and is desired to be moved to its retracted, stowed, or concealed or covered position, as illustrated within FIG. 7, the user exerts a force upon the forward face of the upper front panel 104 of the armrest 106 of the chair 108 and moves the same rearwardly.

Obviously, many variations and modifications of the present invention are possible in light of the above teachings. It is therefore to be understood that within the scope of the appended claims, the present invention may be practiced otherwise than as specifically described herein.

What is claimed is:

1. A concealed cup holder assembly for a furniture piece, comprising:

at least one armrest mounted upon said furniture piece;

at least one front panel member pivotally mounted upon said at least one armrest;

at least one cup holder housing fixedly connected to said at least one front panel member;

a cup holder mounted within said at least one cup holder housing;

at least one internal support panel disposed within said at least one armrest of said furniture piece; and a telescopic cylinder interconnecting said at least one internal support panel to said at least one front panel member, for movement between extended and retracted positions, such that when said cup holder is disposed at said retracted position, said telescopic cylinder will be disposed substantially parallel to said at least one internal support panel of said at least one armrest of said furniture piece, whereas when said cup holder is disposed at its extended position, said telescopic cylinder will be disposed at a predetermined inclined position with respect to said at least one internal support panel of said at least one armrest of said furniture piece.

2. The concealed cup holder assembly as set forth in claim 1, wherein:

said at least one front panel member pivotally mounted upon said at least one armrest comprises an upper front panel member of said at least one armrest.

3. The concealed cup holder assembly as set forth in claim 1, wherein:

said at least one armrest comprises a fixed, lower front panel member; and said at least one front panel member comprises an upper front panel member pivotally mounted upon said fixed, lower front panel member of said at least one armrest.

4. The concealed cup holder assembly as set forth in claim 1, wherein:

said at least one cup holder housing has a front panel member thereof fixedly mounted upon said at least one front panel member pivotally mounted upon said at least one armrest of said furniture piece.

5. The concealed cup holder assembly as set forth in claim 1, wherein:

said cup holder is mounted within an upper panel member of said at least one cup holder housing.

6. The concealed cup holder assembly as set forth in claim 4, wherein:

said at least one telescopic cylinder is operatively connected to a rear panel member of said at least one cup holder housing.

7. The concealed cup holder assembly as set forth in claim 6, wherein:

a first end of said at least one telescopic cylinder is pivotally connected to said rear panel member of said at least one cup holder housing by a first pivot mechanism.

8. The concealed cup holder assembly as set forth in claim 7, wherein:

a second end of said at least one telescopic cylinder is pivotally connected to said at least one internal support panel, disposed within said at least one armrest of said furniture piece, by a second pivot mechanism.

9. The concealed cup holder assembly as set forth in claim 7, wherein:

said first pivot mechanism comprises a housing having a female hole/aperture defined therein, and a male pin, mounted upon a mounting bracket fixedly secured to said rear panel member of said at least one cup holder housing.

10. The concealed cup holder assembly as set forth in claim 8, wherein:

said second pivot mechanism comprises a housing having a female hole/aperture defined therein, and a male pin, mounted upon a mounting bracket fixedly secured to said at least one internal support panel disposed within said at least one armrest of said furniture piece.

11. A concealed cup holder assembly for a furniture piece, comprising:

at least one armrest mounted upon said furniture piece;

at least one front panel member pivotally mounted upon said at least one armrest;

at least one cup holder housing fixedly connected to said at least one front panel member;

a cup holder mounted within said at least one cup holder housing;

at least one internal support panel disposed within said at least one armrest of said furniture piece; and a telescopic cylinder interconnecting said at least one internal support panel to said at least one front panel member, for movement between extended and retracted positions, such that when said cup holder is disposed at said retracted position, said telescopic cylinder will be disposed substantially parallel to said at least one internal support panel of said at least one armrest of said furniture piece, whereas when said cup holder is disposed at its extended position, said telescopic cylinder will be disposed at a predetermined inclined position with respect to said at least one internal support panel of said at least one armrest of said furniture piece whereby said positions of said telescopic cylinder contribute to a compact, small footprint of said concealed cup holder assembly.

12. The concealed cup holder assembly as set forth in claim 11, wherein:

said at least one front panel member pivotally mounted upon said at least one armrest comprises an upper front panel member of said at least one armrest.

13. The concealed cup holder assembly as set forth in claim 11, wherein:

said at least one armrest comprises a fixed, lower front panel member; and said at least one front panel member comprises an upper front panel member pivotally mounted upon said fixed, lower front panel member of said at least one armrest.

14. The concealed cup holder assembly as set forth in claim 11, wherein:

said at least one cup holder housing has a front panel member thereof fixedly mounted upon said at least one front panel member pivotally mounted upon said at least one armrest of said furniture piece.

15. The concealed cup holder assembly as set forth in claim 11, wherein:

said cup holder is mounted within an upper panel member of said at least one cup holder housing.

16. The concealed cup holder assembly as set forth in claim 14, wherein:

said at least one telescopic cylinder is operatively connected to a rear panel member of said at least one cup holder housing.

17. The concealed cup holder assembly as set forth in claim 16, wherein:

a first end of said at least one telescopic cylinder is pivotally connected to said rear panel member of said at least one cup holder housing by a first pivot mechanism.

18. The concealed cup holder assembly as set forth in claim 17, wherein:

a second end of said at least one telescopic cylinder is pivotally connected to said at least one internal support panel, disposed within said at least one armrest of said furniture piece, by a second pivot mechanism.

19. The concealed cup holder assembly as set forth in claim 17, wherein:

said first pivot mechanism comprises a housing having a female hole/aperture defined therein, and a male pin, mounted upon a mounting bracket fixedly secured to said rear panel member of said at least one cup holder housing.

20. The concealed cup holder assembly as set forth in claim 18, wherein:

said second pivot mechanism comprises a housing having a female hole/aperture defined therein, and a male pin, mounted upon a mounting bracket fixedly secured to said at least one internal support panel disposed within said at least one armrest of said furniture piece.

* * * * *